United States Patent [19]

Hammett

[11] 4,421,051

[45] Dec. 20, 1983

[54] AUXILIARY BOOM FOR EMERGENCY EVACUATION

[75] Inventor: Dillard S. Hammett, Dallas, Tex.

[73] Assignee: Sedco, Inc., Dallas, Tex.

[21] Appl. No.: 88,761

[22] Filed: Oct. 29, 1979

[51] Int. Cl.[3] ..... B63B 35/00

[52] U.S. Cl. ..... 114/264; 212/190; 14/71.1

[58] Field of Search ..... 114/230, 264, 265, 221 R, 114/145 B; 14/69.5, 71.1; 212/190, 209, 223, 230, 187; 182/10

[56] References Cited

U.S. PATENT DOCUMENTS

| | | | |
|---|---|---|---|
| 1,161,680 | 11/1915 | Hulett et al. | 212/190 |
| 3,045,837 | 7/1962 | Liebherr et al. | 212/187 |
| 3,880,254 | 4/1975 | Fitzgerald et al. | 182/10 |
| 3,894,503 | 7/1975 | McClure | 212/192 |
| 3,987,744 | 10/1976 | Blumberg et al. | 114/145 B |
| 4,003,473 | 1/1977 | Ryan | 114/230 |
| 4,169,296 | 10/1979 | Wipkink et al. | 14/71.1 |

FOREIGN PATENT DOCUMENTS

| | | | |
|---|---|---|---|
| 2335163 | 1/1975 | Fed. Rep. of Germany | 114/221 R |

*Primary Examiner*—Trygve M. Blix
*Assistant Examiner*—Jesús D. Sotelo
*Attorney, Agent, or Firm*—Hubbard, Thurman, Turner & Tucker

[57] ABSTRACT

An apparatus and method for erecting a temporary emergency walkway for personnel between an offshore oil platform and a marine vessel. The disclosed apparatus includes a first walkway attached to the main boom of a crane mounted on the vessel and a second walkway attached to an extendable articulating auxiliary boom. The auxiliary boom, which is normally stored on the deck of the vessel, preferably includes an articulating section having a pair of pivotably connected subsections and an adjoining section which telescopically engages the articulating section. A rapid evacuation of personnel from the platform can be accomplished even in heavy seas by maneuvering the vessel into a position near the endangered platform, attaching the auxiliary boom to the main boom and by appropriate movements of the crane and auxiliary boom placing the end of the auxiliary boom on the platform. After the auxiliary boom has been secured to the deck of the oil platform, personnel can use the walkway so erected to move to a position of safety on the vessel, the emergency crews can move from the service vessel to the platform. The booms also may provide air, hydraulic, and electrical power from the vessel to the platform.

12 Claims, 11 Drawing Figures

64
72
70
68
74
156
10
12
14
16
18
20
22,24
26,28
30,32
34,36
38,40
42,44
46,48
50
52
54
56
58
60
150
150
170

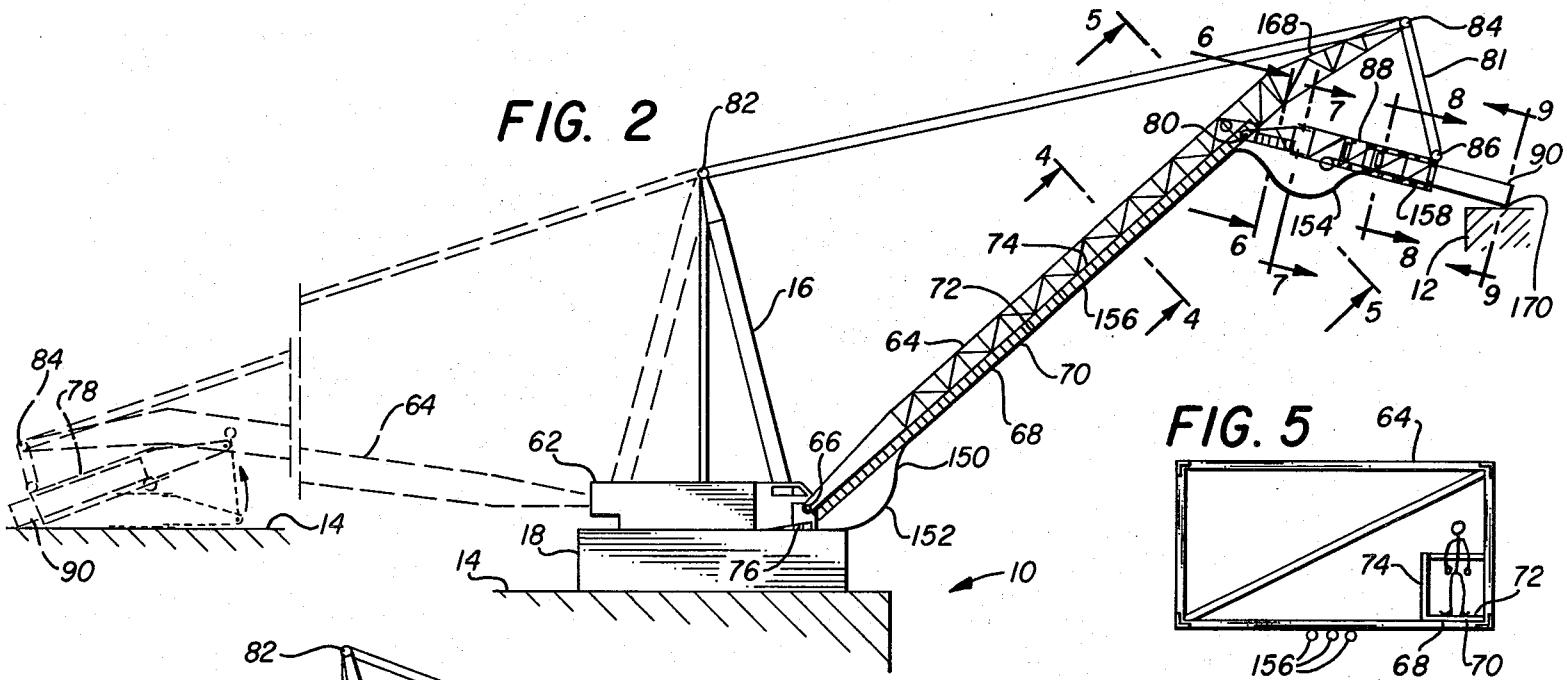
FIG. 2
FIG. 5
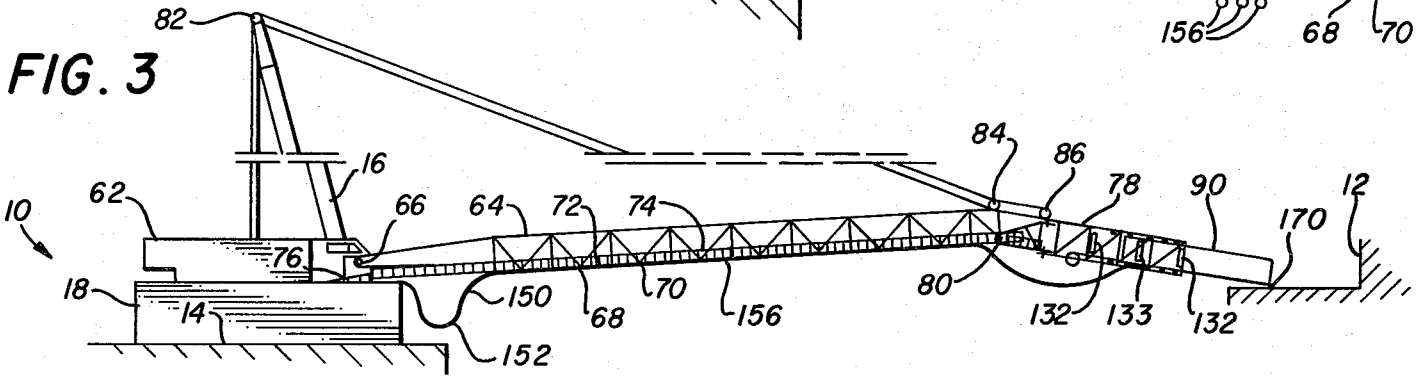
FIG. 3

AUXILIARY BOOM FOR EMERGENCY EVACUATION

BACKGROUND OF THE INVENTION

This invention relates generally to a rescue device for use in marine operations and more particularly to an apparatus and method for erecting a temporary emergency walkway for personnel between an offshore oil platform and a vessel. For the purposes of this disclosure, the term "oil platform" shall be understood to refer to any offshore structure used in connection with the exploration for or recovery of oil and/or natural gas.

In earlier years offshore activity was generally limited to relatively shallow and calm waters such as the Gulf of Mexico. As the demand for oil has increased, however, the trend has been to explore and drill in deeper and more dangerous waters. There has been much effort and investment made in the development of various tracts in the North Sea. In that area drilling has been conducted in water varying in depth between three and six hundred feet and production platforms are currently under construction in water of such depths.

The North Sea is a relatively rough body of water. In certain areas, the mean wave height is six feet or greater about 35% of the time. As a result, marine operations are frequently interrupted due to heavy seas. Oil drilling and production in an environment of this sort inherently involves greater risk for workers on the platforms than they might be exposed to in calmer, warmer oceans. If the crew of an offshore oil platform is forced to evacuate the platform because of an actual or impending disaster, they may be exposed to a very hostile ocean environment requiring special protection for survival. Most platforms are equipped with the conventional lifeboats and in some cases with rather sophisticated self-contained escape vessels which are completely enclosed and self-propelled. While conventional open life boats may provide a satisfactory means of escape in some situations, they may be totally inadequate in the North Sea. They are easily swamped or capsized in heavy seas and offer the crew little protection from exposure to such cold waters.

The more sophisticated escape vessels offer greater protection but they also may become unmanageable in bad weather. Due to their greater complexity, the probability of their malfunctioning is inherently greater. Also, when the possibility of a fire arises, or a fire actually occurs on a platform, one of the first safety measures taken is to shut off all power on the platform. If it subsequently becomes necessary thereafter to evacuate the crew, power will not be available to activate or launch an escape vessel. Under such circumstances, it may even be unsafe to start the engine of an escape vessel in the immediate vicinity of the platform.

In some instances, helicopters have been successfully used to rescue endangered personnel from oil platforms. If the platform is actually on fire, however, it may not be safe to approach it with a helicopter. Also, the relatively small passenger carrying capacity of most rescue helicopters makes it impractical to use them to evacuate large crews which will man the giant platforms which are under construction or planned for the future.

Accordingly, it can be seen then that under many circumstances the various escape devices presently known and used in connection with oil platforms may be of little or no use to an endangered crew in an environment such as the North Sea.

Also, it may be necessary after the platform has been abandoned and the fire, if any, has been extinguished to reboard the platform to cap the damaged wellheads. Under these circumstances, the danger of fire or explosion may still exist and the reboarding must be accomplished quickly and as safely as possible regardless of the existing weather conditions. If the seas are high, it may be difficult or impossible to board the platform from a conventional boat. Approaching in a helicopter may be unsafe due to the danger of another explosion.

Accordingly, it is an object of this invention to provide an apparatus and method for safely evacuating personnel from an offshore oil platform in heavy seas.

It is also an object of this invention to provide for an apparatus which can be used by personnel to safely and quickly reboard an abandoned, powerless platform in heavy seas after an explosion or fire thereon has been brought under control, and to provide the personnel with power from a service vessel.

It is a further object of this invention to provide an apparatus and method for quickly and safely evacuating relatively large crews from offshore platforms under weather conditions more severe than could be contended with by devices known in the prior art.

SUMMARY OF THE INVENTION

This invention can be broadly summarized as a self-propelled vessel which includes a system for maintaining the vessel at a predetermined position with respect to the oil platform, a revolving crane mounted on the vessel for rotation about a vertical axis, an auxiliary boom mounted on the main boom of the crane and being capable of articulation with respect to the main boom, a first walkway forming a passageway for personnel on the main boom, a second walkway forming a passageway for personnel on the auxiliary boom and cooperating with the first walkway to form a passageway for personnel between the vessel and the platform when the auxiliary boom is rested on the platform.

This invention can also be summarized as an axuiliary boom adapted for use with a revolving crane wherein the crane has a main boom and first walkway means, and wherein the auxiliary boom includes a means permitting articulation of the auxiliary boom with respect to the main boom, and further includes a second walkway means forming a passageway for personnel on the auxiliary boom and cooperating with the first walkway means to form a passageway for personnel between a service vessel and an offshore oil platform when the auxiliary boom is rested on the platform. The preferred embodiment of the auxiliary boom includes an articulating section having a pair of pivotally connected subsections and an adjoining section operably engaging the articulating section so as to compensate for three degrees of relative motion between the vessel and the platform. The adjoining section preferably includes a plurality of walls and a floor cooperating to form a protective enclosure. The invention may also include a utility service means attached to and extending along the main and auxiliary booms for extending a variety of utility services from the vessel to the platform.

Finally, this invention may also be summarized as a method for erecting a temporary walkway between an offshore oil platform and a vessel equipped with a revolving crane having a main boom and a first walkway means which includes the steps of mounting an extendable, articulating auxiliary boom having a second walkway means to the main boom, maneuvering the service vessel into a position proximate the oil platform, and positioning the auxiliary boom on the platform while substantially maintaining the position of the service vessel with respect to the oil platform.

BRIEF DESCRIPTION OF THE DRAWINGS

FIG. 1 is a side elevation of an offshore platform and service vessel including the present invention with the crane illustrated in solid outline in one operating position and in phantom outline in a second operating position.

FIG. 2 is a side elevation of the revolving crane and auxiliary boom of FIG. 1 and shows in phantom the removal of the auxiliary boom from a storage position on the deck of the vessel of FIG. 1.

FIG. 3 is an alternate embodiment of the revolving crane and auxiliary boom of FIG. 1 in which the outer portion of the main boom has been removed and the auxiliary boom has been positioned at the outer end of the remaining portion of the main boom. FIGS. 4 through 9 are cross sections taken at positions 4—4 through 9—9, respectively in FIG. 2.

FIG. 10 is a sectional view of the auxiliary boom taken at position 10—10 of FIG. 8.

FIG. 11 is a top view of one section of the auxiliary boom showing the pivotal connection between subsections thereof.

DESCRIPTION OF THE PREFERRED EMBODIMENTS

Figures 1, 4:
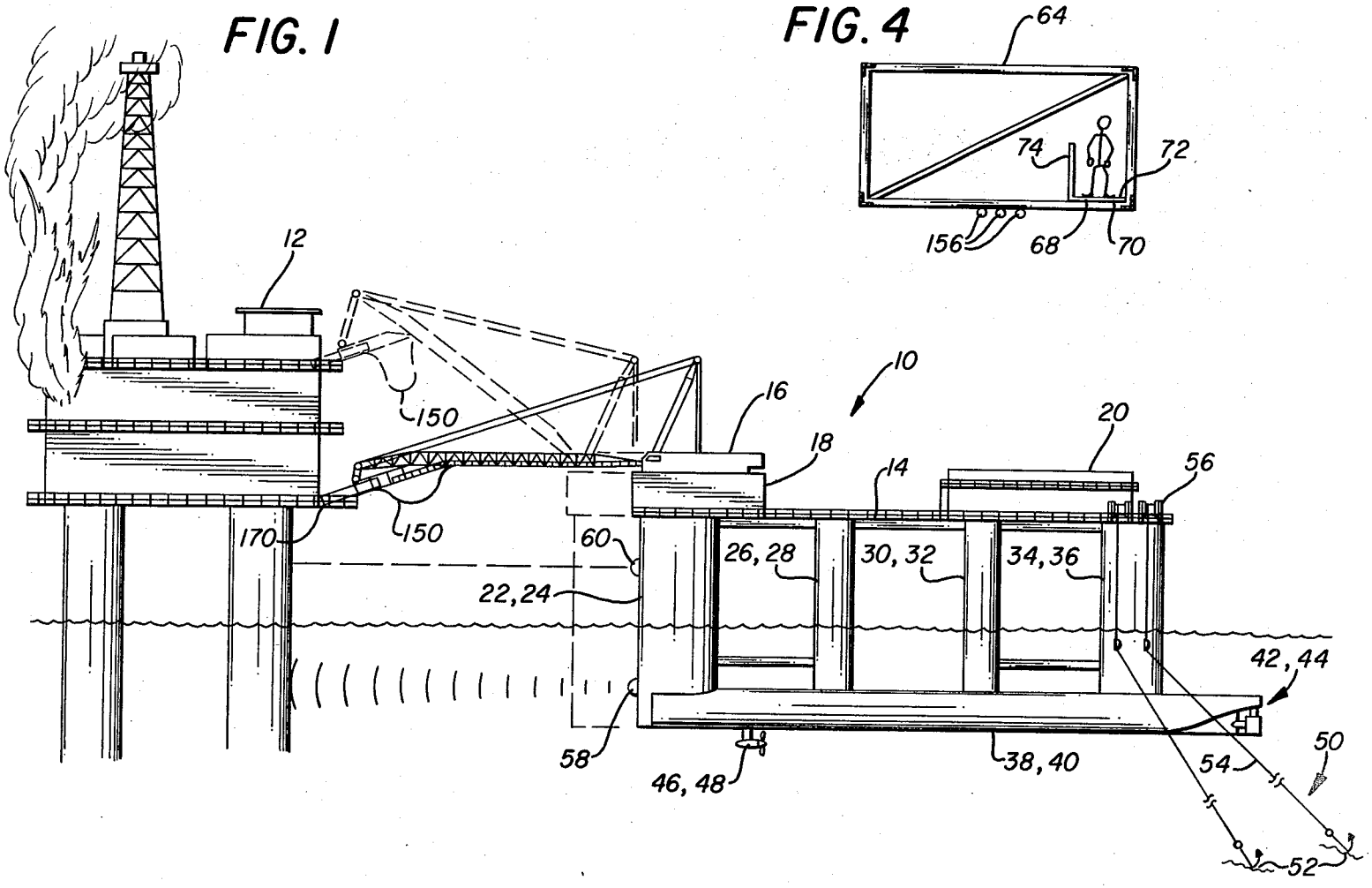

FIG. 1 illustrates one embodiment of the present invention in operation. In that view marine service vessel 10 is shown anchored in a standoff position from oil production platform 12 upon which a fire is burning. Vessel 10 is of the type generally known in the art as a semi-submersible and may be more particularly described as a self-propelled column stabilized semi-submersible fire control vessel. Due to its overall size and particular design features, it is especially suited for use under conditions such as are encountered in the North Sea. The vessel has a rectangular main deck 14 which is approximately 400 feet long and 200 feet wide. The deck supports a 350 ton capacity revolving crane 16 which is mounted on base 18 for rotation about an axis which is vertical, or normal to deck 14. Also, located on the deck is aft deck house 20, a two story structure which includes living quarters, shops, control and engine rooms. The deck is supported by two forward stability columns 22 and 24, four intermediate stability columns 26, 28, 30 and 32, and two aft stability columns 34 and 36. In this view, only columns 22, 26, 30 and 34 are visible. The four visible stability columns are joined at their lower end to a generally cylindrical, slender elongated lower hull 38. Similarly, the four remaining columns, 24, 28, 32 and 36, are joined at their lower ends to lower hull 40, not visible in this view, which is oriented parallel to lower hull 38 and spaced apart from it a distance of approximately 195 feet, center to center. The length of each lower hull is approximately 450 feet and the distance from the bottom of the lower hulls to the main deck is approximately 160 feet. Additional support and stability for the structure is provided by a plurality of truss members, not shown in this view, some of which interconnect opposing pairs of stability columns such as 22 and 24 and some of which interconnect the upper deck and the stability columns.

Buoyancy for the vessel is provided by the eight stability columns and the two lower hulls. The columns may contain combinations of buoyant void tanks, ballast tanks and equipment storage areas. One forward stability column also includes a fire pump room. The lower hulls contain pump room compartments, ballasting tanks, and a series of tanks for storing fuel oil and fresh water.

Propulsion for the vessel is provided by port and starboard propulsion units 42 and 44 which are located at the aft end of lower hulls 38 and 40, respectively. Each unit includes a conventional propeller enclosed within a Kort nozzle and driven by an engine located in the aft end of its associated lower hull. Directional control of the vessel is provided by a pair of azimuthing thruster assemblies 46 and 48 which are located near the forward ends of lower hulls 38 and 40, respectively.

The preferred vessel can achieve speeds up to 10 knots in calm water and has sufficient fuel capacity to travel up to 10 days at maximum speed. In heavy seas the vessel exhibits a stability which is characteristic of column stabilized semi-submersibles. When operating in a draft of 60 feet in 30 foot waves, the vessel's vertical motion or heave will be only about 3 feet and its pitch and roll only about two degrees. The vessel's normal operating draft is 60 feet but it can propel itself through waters as shallow as 21 feet.

It this invention is to be used in areas where the seas are relatively calm, a conventional vessel such as a barge might be used. But such barges can normally not be operated when the seas are higher than six feet. Accordingly, since this invention is intended for use in rough waters such as the North Sea, a more versatile vessel such as a semi-submersible is preferable.

The vessel employed in this invention must also be capable of maintaining a position (referred to as a "standoff position") with respect to an offshore oil platform during operation. While in some situations, a simple anchoring system might be sufficient, the preferred vessel employs a combination of an anchoring system, the propulsion and thrustor motors previously mentioned, and two independent ranging systems to ensure relatively accurate station keeping, even in heavy seas. The anchoring system consists of 8 anchor assemblies of which anchor assembly 50 is typical. Anchor assembly 50 includes a 30,000 danforth-type anchor 52 which is secured to 3 inch diameter wire mooring line 54. The mooring line is controlled by a double drum winch 56 which is capable of holding 4,700 feet of mooring line. Each winch may be controlled either from an associated control panel housed in a nearby protective enclosure or from a remote control console located in deck house 20.

Normlly, when the vessel is engaged in a rescue operation, it will be positioned upwind of platform 12. Under such circumstances, the wind and sea will tend to move the vessel toward the platform so rear anchors will be deployed from the rear of the vessel to limit its movement in that direction. If time permits, other anchors will be deployed on either side of the vessel to further stabilize its position. Under circumstances where a direct upwind approach is not possible, thrustors and propulsion units will be employed independently or in combination to assist in maintaining the desired position of the vessel and proper tension on the mooring lines.

Once the auxiliary boom has been positioned on the platform, it is necessary that the distance between the vessel and the platform be continuously monitored and maintained with relative accuracy. For this purpose, the preferred embodiment includes two independent measuring means, a sonar system 58 and a laser ranging system 60. The sonar system is used to determine the range to underwater objects and is sensitive enough to detect a 6 inch pipe at a range of 1,000 feet and to indicate that range to an accuracy of within one foot. The laser system 60, used to indicate the distance between vessel 10 and objects above the water, is capable of indicating the range of an object 500 feet away to an accuracy of one inch. Both systems are used to monitor continuously and will trigger an alarm if the range of the detected object is less than a preselected minimum.

In FIGS. 2 and 3, revolving crane 16 is shown in greater detail. The crane itself is of generally conventional design, having a main boom 64 which is pivotally mounted at point 66 for rotation about a horizontal axis. Attached to the main boom is main boom walkway 68 which extends from the inner end of the boom near point 66 outward along the boom. The walkway includes a floor 70 which is heavily roughened on its upper surface 72 to provide safe footing even when the surface is wet. If the walkway is to be used under freezing conditions, it may be necessary to provide some means for deicing the walkway in order to ensure safe passage. For additional safety, the walkway also includes a hand rail section 74 which extends along its entire length. When the walkway is in use, portable ramp 76 is secured to base 18 near point 66 to complete the path to the vessel. The height and location of the ramp may be adjusted to accomodate various boom angles. Walkway 68 may be permanently attached to the main boom or it may be composed of a series of removable sections which can be detached from the main boom and stored on deck 14 when not in use. Details of the central portion of the walkway are also shown in the sectional view of FIG. 4.

Also attached to the main boom is auxiliary boom 78 which is pivotally mounted thereto at point 80 for rotation about a generally horizontal axis. Cable system 81, which extends from crane base 62 through blocks 82, 84 and 86, controls the position of auxiliary boom 78 with respect to main boom 64. As further illustrted in FIGS. 6 through 11, the auxiliary boom is composed of articulating section 88 which is pivotably mounted to the main boom and an enclosed section 90 which telescopically engages the articulating section. The articulating section includes subsections 92 and 94 which are joined at points 96 and 98 for articulation about an axis passing through those two points. Subsection 92 is joined to the main boom by removable pin 106 which passes through holes in members 166. The pin 106 also passes through associated holes in reinforcing plates, such as plate 110, of the main boom as shown. Subsection 92 also includes a pair of semicircular reinforcing plates 112 and 114 which are rotatably joined by pins 116 and 118 to mating reinforcing plates 120 and 122, respectively, of subsection 94. Accordingly, it can be seen then that the pin joints described permit articulation of the section 90 about two mutually orthogonal axes with respect to the main boom.

Section 90 of the auxiliary boom is an enclosed structure containing entrances 124 and 126 at the opposing ends and is designed to provide its occupants with some degree of heat and blast protection. It telescopically engages section 88 and is free to translate with respect thereto on rollers 128. Cushioned stops 132 and 133 are positioned as shown to limit the telescoping motion of section 90. Thus, by means of the two above described pin joints and its telescopic engagement with section 88, section 90 is permitted three degrees of freedom with respect to the service vessel and can be secured to platform 12 even in relatively heavy seas.

Referring to FIG. 11 and again to FIG. 2, it can be seen that the auxiliary boom includes a walkway which provides a passageway between the outer end of main boom walkway 68 and entrance 126 of the enclosed section 90. The preferred embodiment of the walkway consists of two sections 136 and 138 which are similar in construction to main boom walkway 68 and which are attached to articulating subsections 92 and 94, respectively. Each walkway has a floor 140 and a handrail 142 and cooperate to form a safe passageway along sections 92 and 94 even when they are moving relative to each other. The intersection of the two walkways near plate 114 can be formed of sliding plates or other suitable means.

Figures 6, 7, 8, 9, 10, 11:
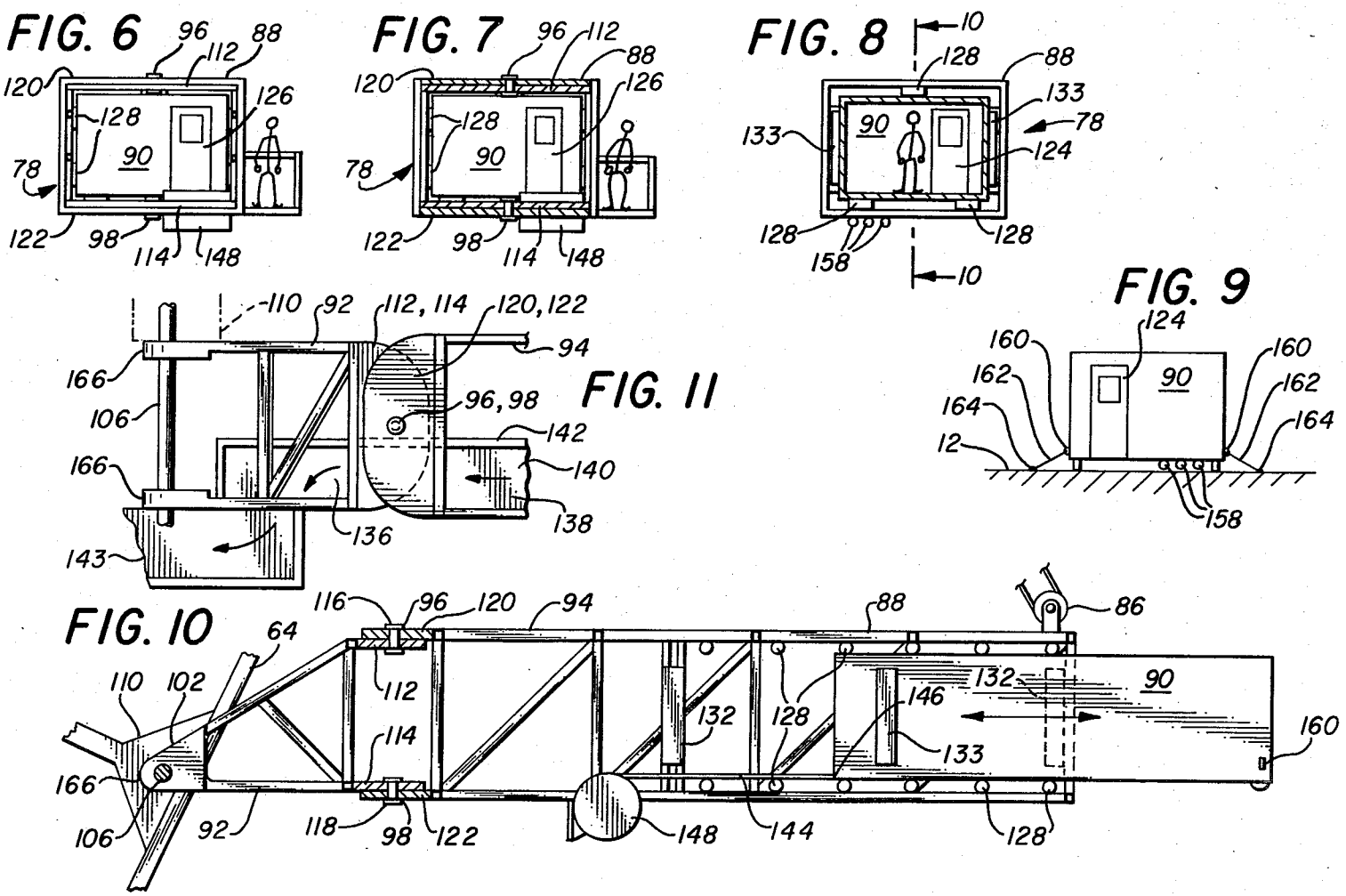

Because the auxiliary boom is more narrow than the main boom, walkway 136 is provided with extension 143 to complete the path to main boom walkway 68. The junction between walkway 68 and extension 143 can be formed of any suitable flexible material. In FIG. 11, the arrow on the walkway floor indicates the path followed by personnel as they move from the auxiliary boom to the main boom along the walkways.

The auxiliary boom walkway also includes a variable length walkway which extends between entrance 126 of enclosed section 90 and the right-hand end of walkway 138 as illustrated in FIG. 10. The variable length walkway includes a flexible walkway belt 144 supported by rollers 128 and attached at its right-hand end 146 to enclosed section 90. On the opposite end, the walkway belt enters accumulator 148 which keeps the belt under tension as enclosed section 90 is moved in either direction with respect to section 88. In the preferred embodiment, a portion of the belt is stored within the accumulator on a sring biased roller, but a variety of means can be substituted to maintain tension on the belt or to provide a variable length walkway between the two sections.

The present invention also includes means for extending various utility services from service vessel 10 to an oil platform. This feature can be especially useful when the invention is being used to permit personnel from the service vessel to reboard a disabled and powerless platform. In FIGS. 1 and 2, utility service lines 150 are shown extending from a location on the service vessel near the base of crane 16 out along the main auxiliary booms to platform 12. Service lines preferably include flexible sections 152 and 154 which extend between crane base 18 and the main boom and between the main and auxiliary booms, respectively. Section 156, which joins flexible sections 152 and 154 may be made of a relatively rigid material such as pipe and may be either permanently or temporarily attached to the main boom. Similarly, section 158 is attached to enclosure 90 and joins section 154. Suitable connectors and extension lines can be employed at the ends of section 158 near entrance 124 to permit the extension of the utility line to other locations on the platform.

Because the invention may be employed in heavy seas which may produce significant relative motion between service vessel 10 and platform 12, it is necessary that means also be provided to secure section 90 to the platform while personnel are being transferred. For this purpose, a plurality of tie downs 160 have been provided near the outer end of section 90 as shown in FIGS. 9 and 10. Tie down lines 162, attached to these tie downs, may be attached to appropriate tie down points 164 on the platform to limit the relative motion between the platform and the end of the evacuation boom.

FIG. 3 illustrates a second embodiment of the present invention which permits the main and auxiliary booms to be positioned in a more nearly horizontal position and thus reduce the slope of the walkways. In this embodiment, outer end 168 of the main boom is completely removed prior to attaching the auxiliary boom. After the boom is attached, block assemblies 84 and 86 are positioned on the main and auxiliary booms, respectively, as shown. Otherwise the construction and operation of this embodiment is similar to that described for the embodiment of FIG. 2.

When an emergency call is received from an offshore oil platform and it is determined the personnel on the platform should be evacuated for their safety, service vessel 10 will proceed to the vicinity of the endangered platform. Ordinarily the platform will be approached from the upwind side to give the service vessel and its crew maximum protection from a fire on the platform. When the vessel nears the platform, rear anchors such as anchors 52 will be deployed to control the final approach to a standoff position. Sonar system 58 and laser ranging system 60 will be employed to accurately indicate the range between underwater and above water portions of the platform and the service vessel. The vessel will then be carefully maneuvered into a preselected final standoff position from which the end of the auxiliary boom can be placed in the desired resting position on the platform.

Next, crane 16 will be rotated into the position shown in phantom in FIG. 2 above the stored evacuation boom. End 166 of the evacuation boom will then be raised into position with a winch or other means so that holes in members 100 and 102 and reinforcing plates 108 and 110 are in alignment. Next, pin 106 is locked in place and control cables 80 are secured to the auxiliary boom. Walkway 70 is then attached to the main boom if it is not carried as a permanent part of the structure. Finally, utility service lines 150 are added, if necessary. The main boom can then be raised and rotated into the position shown in FIG. 1.

With the service vessel being held in the selected standoff position, end 170 of the section 90 is then carefully positioned on the platform by appropriate movements of the main and auxiliary booms. After tie down cables have been secured, the evacuation of the platform crew can begin. In the event an even faster evacuation is necessary, the entire crew can be loaded into section 90, entrances 124 and 126 can be sealed, and the boom can be immediately raised and rotated away from the platform. After the boom has been positioned over deck 14 and lowered, the crew can be permitted to exit directly onto the deck.

Thus, it can be seen this invention provides for a method and apparatus for erecting a temporary emergency walkway for personnel between an offshore oil platform and a, preferably semi-submersible, marine service vessel. Although only two specific embodiments of this invention have been illustrated and described, it is to be understood that obvious modifications may be made of them without departing from the true spirit and scope of this invention.

What is claimed is:

1. A method for erecting a temporary walkway between a marine service vessel equipped with a revolving crane having a main boom and an offshore oil platform comprising the steps of:

attaching a first walkway to said main boom;

mounting an extendable, articulating auxiliary boom to said main boom, said auxiliary boom including an extendable walkway;

maneuvering said service vessel into a position proximate said drilling platform;

positioning said auxiliary boom on said platform while substantially maintaining the position of said service vessel with respect to said platform.

2. A self-propelled vessel for servicing an offshore oil platform comprising:

means for maintaining said vessel at a predetermined position with respect to said platform;

a revolving crane mounted on said vessel for rotation about a vertical axis, said crane including a base and a main boom pivotally mounted for rotation about a horizontal axis;

an auxiliary boom mounted on said main boom and including means permitting articulation of said auxiliary boom with respect to said main boom;

said auxiliary boom comprising an articulating section having a pair of pivotally-connected subsections, and an adjoining section operably engaging said articulating section, and capable of translating with respect thereto;

first walkway means forming a passageway for personnel on said main boom; and second walkway means forming a passageway for personnel on said auxiliary boom and cooperating with said first walkway means to form a passageway for personnel between said vessel and said platform when the auxiliary boom is rested on the platform.

3. A self-propelled vessel for servicing an offshore oil platform comprising:

means for maintaining said vessel at a predetermined position with respect to said platform;

a revolving crane mounted on said vessel for rotation about a vertical axis, said crane including a base and a main boom pivotally mounted for rotation about a horizontal axis;

an auxiliary boom mounted on said main boom and including means permitting articulation of said auxiliary boom with respect to said main boom;

said auxiliary boom including an upper section rotatably mounted to said main boom, a lower section telescopically engaging said upper section, and capable of translating with respect thereto, and means for rotating said auxiliary boom with respect to said main boom;

first walkway means forming a passageway for personnel on said main boom; and second walkway means forming a passageway for personnel on said auxiliary boom and cooperating with said first walkway means to form a passageway for personnel between said vessel and said platform when the auxiliary boom is rested on the platform.

4. A self-propelled vessel for servicing an offshore oil platform comprising:

means for maintaining said vessel at a predetermined position with respect to said platform;

a revolving crane mounted on said vessel for rotation about a vertical axis, said crane including a base and a main boom pivotally mounted for rotation about a horizontal axis;

an auxiliary boom mounted on said main boom and including means permitting articulation of said auxiliary boom with respect to said main boom;

first walkway means forming a passageway for personnel on said main boom; and second walkway means forming a passageway for personnel on said auxiliary boom and cooperating with said first walkway means to form a passageway for personnel between said vessel and said platform when the auxiliary boom is rested on the platform, said second walkway means including a portion having a variable length and means for varying the length of said portion.

5. The apparatus of claim 4 wherein said variable length portion includes a flexible walkway belt and said means for varying includes a roller for accumulating said walkway belt.

6. An auxiliary boom adapted for use with a revolving crane on a service vessel, said crane having a first walkway means and a main boom, comprising:

an auxiliary boom structure including means permitting articulation of said auxiliary boom with respect to said main boom, said auxiliary boom including an upper section rotatably mounted to said main boom, and a lower section telescopically engaging said upper section and capable of translating with respect thereto; and second walkway means forming a passageway for personnel on said auxiliary boom and cooperating with said first walkway means to form a passageway for personnel between said vessel and an offshore oil platform when the auxiliary boom is rested on the platform.

7. An auxiliary boom adapted for use with a revolving crane on a service vessel, said crane having a first walkway means and a main boom, comprising:

an auxiliary boom structure including means permitting articulation of said auxiliary boom with respect to said main boom; and second walkway means forming a passageway for personnel on said auxiliary boom and cooperating with said first walkway means to form a passageway for personnel between said vessel and an offshore oil platform when the auxiliary boom is rested on the platform;

said second walkway means including a portion having a variable length and means for varying the length of said portion.

8. The apparatus of claim 7 wherein said variable length portion includes a flexible walkway belt and said means for varying includes a roller for accumulating said walkway belt.

9. A self-propelled vessel for servicing an offshore oil platform comprising:

means for dynamically maintaining said vessel at a predetermined position spaced apart from and unconnected to said platform;

a revolving crane mounted on said vessel for rotation about a vertical axis with respect to said vessel, said crane including a base and a main boom pivotally mounted for rotation about a horizontal axis;

an auxiliary boom mounted on said main boom and including an articulating section having a pair of pivotally-connected subsections, and an adjoining section operably engaging said articulating section and capable of translating with respect thereto, said articulating section permitting articulation of said auxiliary boom with respect to said main boom;

first walkway means forming a passageway for personnel on said main boom; and second walkway means forming a passageway for personnel on said auxiliary boom and cooperating with said first walkway means to form a passageway for personnel between said vessel and said platform when said auxiliary boom is rested on said platform.

10. A self-propelled vessel for servicing an offshore oil platform comprising:

means for dynamically maintaining said vessel at a predetermined position spaced apart from and unconnected to said platform;

a revolving crane mounted on said vessel for rotation about a vertical axis with respect to said vessel, said crane including a base and a main boom pivotally mounted for rotation about a horizontal axis;

an auxiliary boom mounted on said main boom and including means permitting articulation of said auxiliary boom with respect to said main boom, said means including an upper section of said auxiliary boom rotatably mounted to said main boom, a lower section of said auxiliary boom telescopically engaging said upper section and capable of translating with respect thereto, and means for rotating said auxiliary boom with respect to said main boom;

first walkway means forming a passageway for personnel on said main boom and;

second walkway means forming a passageway for personnel on said auxiliary boom and cooperating with said first walkway means to form a passageway for personnel between said vessel and said platform when said auxiliary boom is rested on said platform.

11. A self-propelled vessel for servicing an offshore oil platform comprising:

means for dynamically maintaining said vessel at a predetermined position spaced apart from and unconnected to said platform;

a revolving crane mounted on said vessel for rotation about a vertical axis with respect to said vessel, said crane including a base and a main boom pivotally mounted for rotation about a horizontal axis;

an auxiliary boom mounted on said main boom and including means permitting articulation of said auxiliary boom with respect to said main boom;

first walkway means forming a passageway for personnel on said main boom; and second walkway means forming a passageway for personnel on said auxiliary boom and cooperating with said first walkway means to form a passageway for personnel between said vessel and said platform when said auxiliary boom is rested on said platform, said second walkway means including a portion having a variable length and means for varying the length of said portion of said second walkway means.

12. The apparatus of claim 11 wherein said variable length portion includes a flexible walkway belt and said means for varying includes a roller for accumulating said walkway belt.

* * * * *